US008595864B2

(12) United States Patent
Orita et al.

(10) Patent No.: US 8,595,864 B2
(45) Date of Patent: Dec. 3, 2013

(54) AIR BAG JACKET

(75) Inventors: Masayoshi Orita, Wako (JP); Hiroshi Goto, Wako (JP); Yuki Kobayashi, Wako (JP); Hiroyuki Kikuchi, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 830 days.

(21) Appl. No.: 12/056,981

(22) Filed: Mar. 27, 2008

(65) Prior Publication Data

US 2008/0235854 A1 Oct. 2, 2008

(30) Foreign Application Priority Data

Mar. 30, 2007 (JP) ..... 2007-091902

(51) Int. Cl.
*A41D 1/04* (2006.01)

(52) U.S. Cl.
USPC ..... 2/102; 2/69; 2/456; 2/462; 2/DIG. 3

(58) Field of Classification Search
USPC ..... 2/456, 102, 462, 463, 464, 465, DIG. 3, 2/467, 86, 89, 92, 67, 455, 411, 413, 93; 180/271, 219; 441/88, 102, 106, 108, 441/93, 90, 92, 94, 96, 111; 280/290, 280/728.1, 728.2, 728.3, 730.1, 743.2, 735, 280/734, 733, 729
See application file for complete search history.

(56) References Cited

U.S. PATENT DOCUMENTS

| | | | | | |
|---|---|---|---|---|---|
| 5,605,482 | A * | 2/1997 | Choy | 441/106 |
| 5,759,076 | A * | 6/1998 | Bateman et al. | 441/115 |
| 5,867,842 | A * | 2/1999 | Pinsley et al. | 2/462 |
| 6,125,478 | A * | 10/2000 | Alaloof | 2/456 |
| 6,182,288 | B1 * | 2/2001 | Kibbee | 2/2.5 |
| 6,350,168 | B1 * | 2/2002 | Kroll et al. | 441/111 |
| 6,766,535 | B2 * | 7/2004 | Duhamell et al. | 2/102 |
| 2004/0002270 | A1 * | 1/2004 | Courtney | 441/40 |
| 2004/0033739 | A1 * | 2/2004 | Courtney | 441/88 |
| 2005/0067816 | A1 * | 3/2005 | Buckman | 280/730.1 |
| 2006/0124376 | A1 | 6/2006 | Goto et al. | |
| 2006/0175810 | A1 * | 8/2006 | Goto | 280/730.1 |
| 2008/0289077 | A1 * | 11/2008 | Enlund et al. | 2/81 |

FOREIGN PATENT DOCUMENTS

| | | | |
|---|---|---|---|
| DE | 19640658 | A1 | 4/1998 |
| DE | 102005056344 | A1 | 6/2006 |
| DE | 102006005830 | A1 | 8/2006 |
| JP | 8-512369 | A | 12/1996 |
| JP | 3068775 | U | 2/2000 |
| JP | 2003-138407 | A | 5/2003 |
| JP | 2004-66921 | A | 3/2004 |

* cited by examiner

*Primary Examiner* — Khoa Huynh
*Assistant Examiner* — Khaled Annis
(74) *Attorney, Agent, or Firm* — Westerman, Hattori, Daniels & Adrian, LLP

(57) ABSTRACT

An air bag jacket includes a first portion corresponding to a breast and an upper back portion of a user in a wearing state and a second portion corresponding to a belly and a waist of the user in a wearing state. A recessed portion is cut upwardly from a skirt is formed in the second portion at a position corresponding to either a right or left side of the user. An inflator is arranged on the inside of the recessed portion.

3 Claims, 17 Drawing Sheets

AIR BAG JACKET

FIELD OF INVENTION

The present invention relates to an air bag jacket, and more particularly to an air bag jacket which incorporates an air bag as a buffer device for absorbing a shock felt by a rider of a motorcycle or the like.

BACKGROUND OF THE INVENTION

Recently, as a buffer device for absorbing a shock felt by a rider of a motorcycle or the like, a body wear which incorporates an air inflating chamber (air bag) therein, that is, an air bag jacket has been proposed. For example, Japanese Utility Model Registered Publication 3068775 discloses an air bag having the structure of an inflator in which a compressed air tank is connected to one end of a ventilation valve mounted on a connector communicating with the inside of an air bag, and a sealed port of the compressed air tank is broken using a piercing needle in response to a shock felt by a rider thus rapidly introducing air in the inside of the compressed air tank into the inside of the air bag.

SUMMARY OF THE INVENTION

The conventional air bag jacket described in Japanese Utility Model Registered Publication 3068775 has a stereoscopic structure in which the compressed air tank and the connector which connects the compressed air tank to the air bag project to the outside from the air bag. One problem, however, is that it is difficult to manufacture the jacket while making the projection portion of the compressed air tank and the connector inconspicuous as viewed from the outside without affecting rider comfort.

Thus, one object of the present invention to provide an air bag jacket having a planar structure, which prevents a compressed air tank (inflator) and a connector from projecting from an air bag.

According to one aspect of the present invention, an air bag jacket includes a first portion corresponding to a breast and an upper back portion of a user in a wearing state and a second portion corresponding to a belly and a waist of the user in a wearing state, a recessed portion cut upwardly from a skirt is formed in the second portion at a position corresponding to either a right or left side of the user, and an inflator is arranged in the inside of the recessed portion.

Accordingly, the inflator is accommodated in the recessed portion formed by cutting the air bag jacket upwardly from the skirt and hence, the projection of the inflator toward the outside from the skirt can be prevented whereby it is possible to make the wearing feeling comfortable. For example, the air bag jacket becomes no more bulky even when a rider wears the air bag jacket as an inner wear and, thereafter, wears an outer wear outside the air bag jacket. Thus, it is possible to improve the wearing feeling.

According to another aspect of the present invention, the air bag jacket includes an inflator mounting port which is constituted of a projecting portion formed on a periphery of the recessed portion, and a diffuser casing accommodating a gas blow-off port of the inflator therein is inserted into the inflator mounting port.

Accordingly, the inflator is accommodated in the recessed portion formed by cutting the air bag jacket upwardly from the skirt and hence, the projection of the inflator toward the outside from the skirt can be prevented whereby it is possible to make the wearing feeling comfortable. For example, the air bag jacket becomes no more bulky even when a rider wears the air bag jacket as an inner wear and, thereafter, wears an outer wear outside the air bag jacket. Thus, it is possible to improve the wearing feeling.

According to another aspect of the present invention, an air bag jacket includes a first portion corresponding to a breast and an upper back portion of a user in a wearing state and a second portion corresponding to a belly and a waist of the user in a wearing state, a distal end portion of a cylindrical inflator is engaged with a tubular bulging portion which opens downwardly at a center lower portion of the second portion, that is, a lower portion of the back portion using a first clamp, the inflator is pushed into the inside of the tubular bulging portion while turning over the tubular bulging portion and, thereafter, an outer periphery of the inflator is firmly fastened from above the turned-over tubular bulging portion by a second clamp.

Accordingly, the inflator is firmly fastened in a state that the inflator is pushed into the inside of the air bag jacket and hence, the outward projection of the inflator can be reduced whereby a wearing comfort is improved.

According to another aspect of the present invention, an air bag jacket includes a first portion corresponding to a breast and an upper back portion of a user in a wearing state and a second portion corresponding to a belly and a waist of the user in a wearing state, an opening portion is formed in a center lower portion of the second portion, that is, in a lower portion of the back portion, and a disc-shaped attachment fitted in the opening portion is arranged in a state that a lower surface of the attachment faces the inside of the air bag jacket, and an inflator is arranged in a recessed portion of the attachment.

Accordingly, the inflator is accommodated in the inside of the disc-shaped attachment and does not outwardly project from a surface of the air bag jacket and hence, a wearing comfort is improved.

According to another aspect of the present invention, an air bag jacket includes a first portion corresponding to a breast and an upper back portion of a user in a wearing state and a second portion corresponding to a belly and a waist of the user in a wearing state, an opening portion is formed in a center lower portion of the second portion, that is, in a lower portion of the back portion, the air bag jacket includes an attachment which has a portion for supporting a distal end of a cylindrical inflator and a portion for supporting a rear end of the inflator, and is mounted on the air bag jacket to close the opening portion in a state that the portion for supporting the distal end and the portion for supporting the rear end project toward the inside of the air bag jacket, the portion for supporting the rear end defines a space in a rear portion thereof in a state that the inflator is supported on the portion for supporting the distal end, the space has an opening which extends through the attachment and is communicated with the outside of the air bag jacket, and the opening is configured to be used as an inflator inserting opening at the time of assembling the inflator into the attachment.

Accordingly, the inflator can be assembled into the inside of the air bag jacket through the space for the inflator-rear-end support portion mounted on the attachment joined to the air bag jacket and the opening and hence, an operation to assemble the inflator into the air bag jacket can be improved. Further, the inflator does not outwardly project from the air bag jacket and hence, a wearing comfort is improved.

According to another aspect of the present invention, an air bag jacket includes a first portion corresponding to a breast and an upper back portion of a user in a wearing state and a second portion corresponding to a belly and a waist of the user in a wearing state, the air bag jacket includes an annular support plate which has a bolt joined thereto with a head of the bolt positioned on an air bag jacket side and is held on the second portion of the air bag jacket, and a plate-shaped attachment which is joined to a distal end of an inflator having a gas blow-off port in a state that the distal end penetrates the plate-shaped attachment, and the distal end is made to penetrate a hole formed in the air bag jacket and is made to project to the inside of the air bag jacket, and the attachment is fixed to the support plate by a nut threadedly engaged with the bolt.

Accordingly, the attachment joined to the inflator can be fastened to the air bag jacket by a bolt and hence, the inflator can be easily mounted on the air bag jacket. Particularly, according to the seventh technical feature, the inflator does not outwardly project from a surface of the air bag jacket and hence, a wearing comfort is improved.

According to another aspect of the present invention, an air bag jacket includes a first portion corresponding to a breast and an upper back portion of a user in a wearing state and a second portion corresponding to a belly and a waist of the user in a wearing state, the air bag jacket includes an annular support plate which has a bolt joined thereto with a head of the bolt positioned on an air bag jacket side and is held on the second portion of the air bag jacket, and an attachment which makes a holding member of an inflator positioned in the inside of the air bag jacket and face the support plate, and the attachment is fixed to the support plate by a nut threadedly engaged with the bolt.

Accordingly, the attachment joined to the inflator can be fastened to the air bag jacket by a bolt and hence, the inflator can be easily mounted on the air bag jacket. Particularly, according to the seventh technical feature, the inflator does not outwardly project from a surface of the air bag jacket and hence, a wearing comfort is improved.

According to another aspect of the present invention, an air bag jacket includes a first portion corresponding to a breast and an upper back portion of a user in a wearing state and a second portion corresponding to a belly and a waist of the user in a wearing state, a disc-shaped attachment which is brought into close contact with an outer periphery of a diffuser of an inflator which is constituted of a propellant accommodating casing and the diffuser casing joined to a distal end of the propellant accommodating casing in an orthogonal manner, and holds the inflator in a state that a gas blow-off port is made to project toward the inside of the air bag jacket is joined to a second portion of the air bag jacket, and the disc-shaped attachment is recessed toward an air bag jacket side, and the inflator has at least the diffuser casing thereof accommodated in the inside of a recess of the disc-shaped attachment.

Accordingly, the inflator is accommodated in the inside of the disc-shaped attachment and does not outwardly project from a surface of the air bag jacket and hence, a wearing comfort is improved.

According to another aspect of the present invention, an air bag jacket includes a first portion corresponding to a breast and an upper back portion of a user in a wearing state and a second portion corresponding to a belly and a waist of the user in a wearing state, the air bag jacket includes an inflator accommodated in the inside of the air bag jacket, an inner pedestal on which the inflator is mounted, an outer pedestal which is joined to the inner pedestal by a fastening member such as a bolt, a nut or a rivet, for example, and is arranged outside the air bag jacket, and a wear belt connected to the outer pedestal.

Accordingly, the inflator is fixed to the pedestal and hence, it is possible to surely mount the inflator on a body of a rider using the pedestal.

According to another aspect of the present invention, the inflator has at least a distal end portion having a gas blow-off port arranged to be positioned in the inside of the air bag jacket.

Accordingly, the inflator is fixed to the pedestal and hence, it is possible to surely mount the inflator on a body of a rider using the pedestal.

According to another aspect of the present invention, the air bag jacket includes a common cloth attachment in an elbow shape stitched to the air bag jacket, and a distal end of the cylindrical inflator is fitted and inserted into the attachment.

Accordingly, by forming the attachment and the air bag jacket using the common cloth, the attachment can be easily formed in a stitching step of the air bag jacket.

According to the present invention having the above-mentioned constitutional feature, the inflator can be easily mounted on the air bag jacket in a state that the air bag jacket is developed in plane.

BRIEF DESCRIPTION OF THE DRAWINGS

A preferred embodiment of the present invention will be described with reference to the accompanying drawings, wherein.

DETAILED DESCRIPTION OF THE INVENTION

Hereinafter, one embodiment of the present invention is explained in conjunction with drawings.

Figure 1:
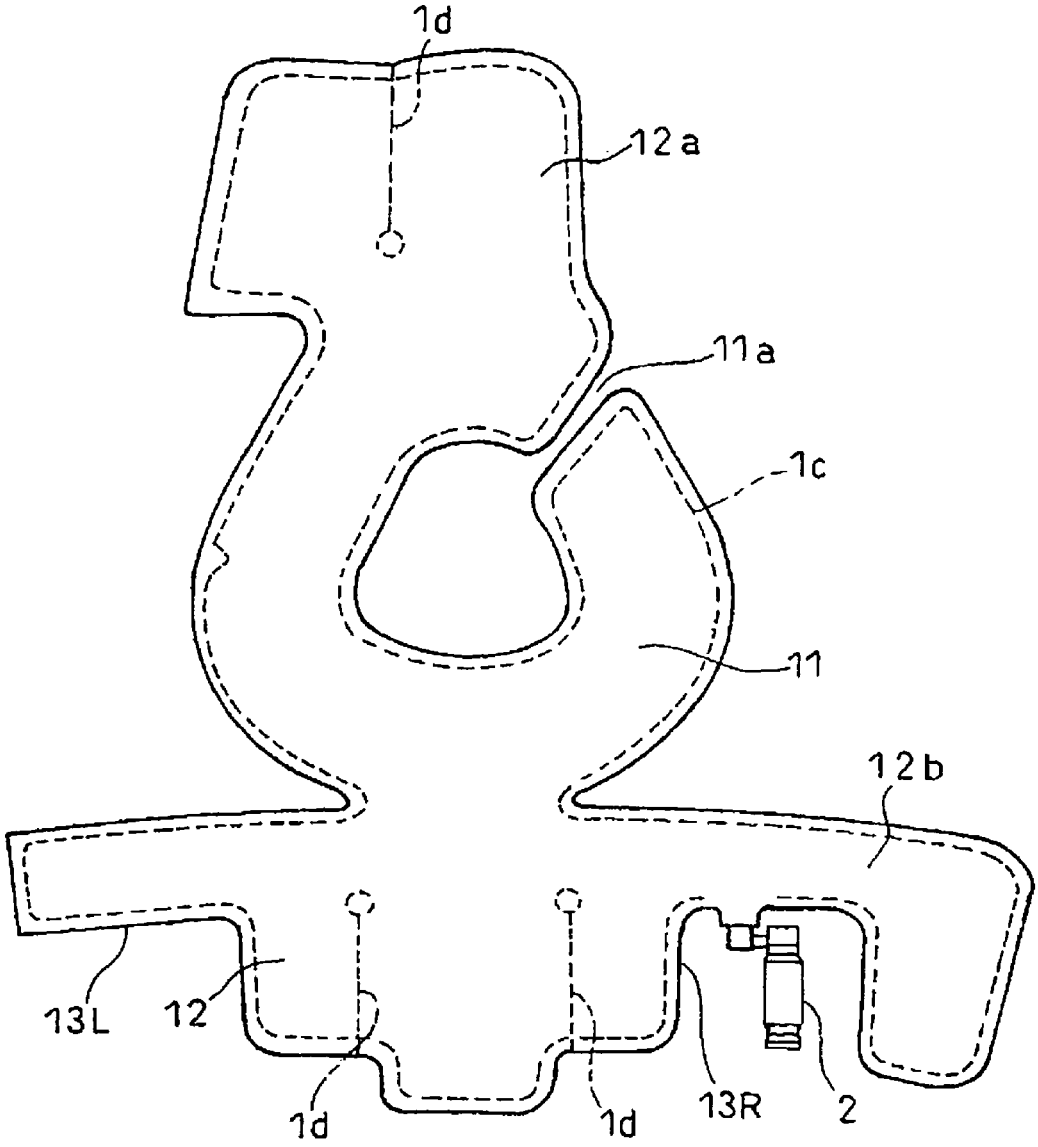
FIG. 1 is a developed view of a rider-use air bag jacket of a motorcycle according to one embodiment of the present invention.
Figure 2:
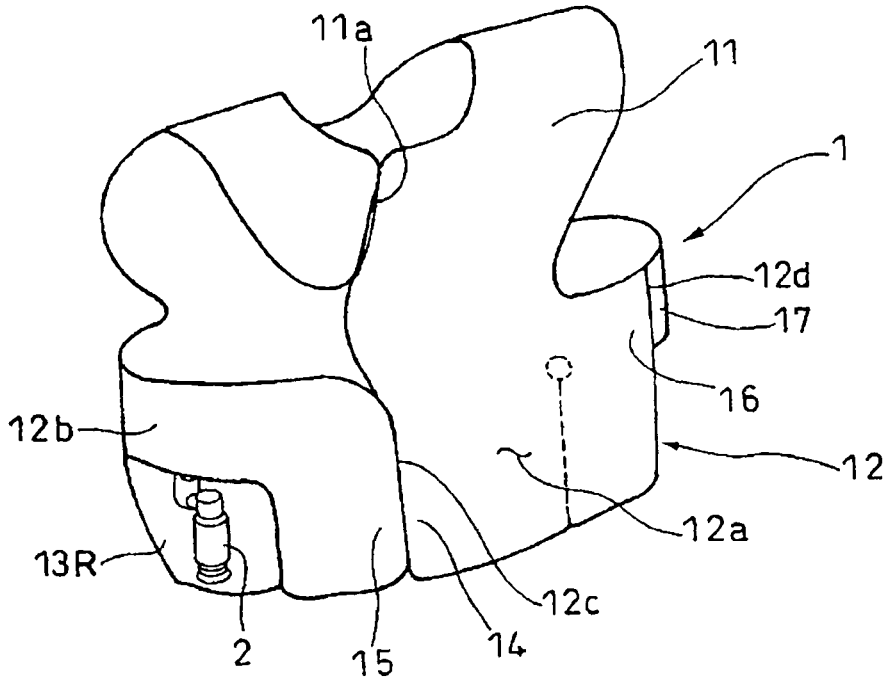
FIG. 2 is a perspective view of a front portion of the air bag jacket.
Figure 3:
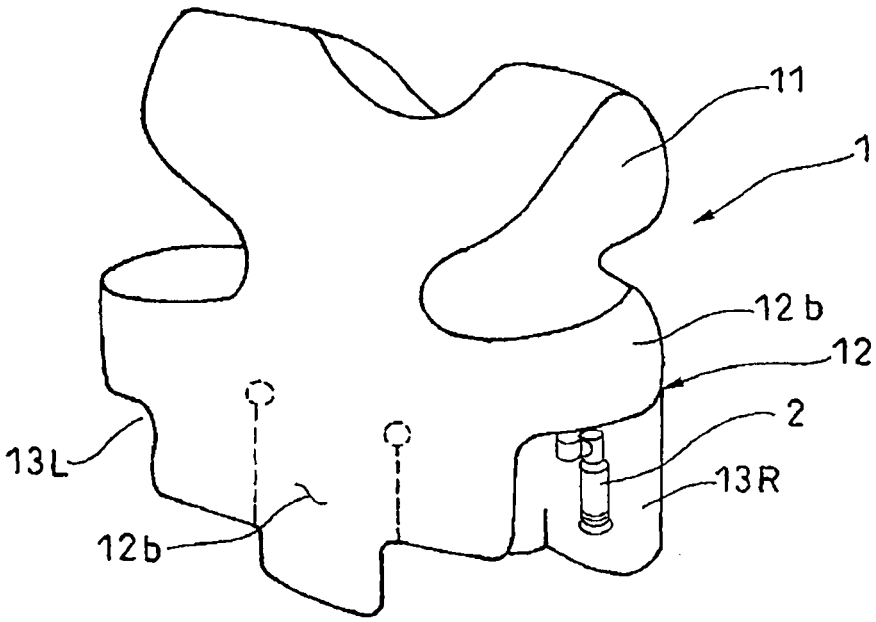
FIG. 3 is a perspective view of a rear portion of the air bag jacket.

FIG. 1 is a developed view of a rider-use air bag jacket of a motorcycle according to one embodiment of the present invention, FIG. 2 is a perspective view of a front portion of the air bag jacket, and FIG. 3 is a perspective view of a rear portion of the air bag jacket. An air bag jacket 1 is constituted of a first portion 11 and a second portion 12. The first portion 11 of the air bag jacket 1 is a portion which corresponds to a region ranging from a breast to an upper back portion of a user in a wearing state and covers the region. The first portion 11 includes an annular portion which surrounds a neck portion of the user. The second portion 12 is a portion which corresponds to a belly and a lower back portion, that is, a waist surrounding region of the user in a wearing state and covers the region. The second portion 12 is constituted of a belly portion 12*a* and a waist portion 12*b*, and gulf-shaped (e.g. rectangular-shaped) recessed portions 13L, 13R which are cut upwardly from a skirt of the air bag jacket 1 are formed in a right side and a left side of the waist portion 12*b*. However, the recessed portion 13L of the left side is joined to a left periphery of the belly portion 12*a* to form a complete recessed portion in a final product and hence, the recessed portion 13L is not described as a complete recessed portion in FIG. 1.

In the recessed portion 13R corresponding to the right side, an inflator 2 is mounted by making use of a space defined in the recessed portion 13R. The air bag jacket 1 is formed of two clothes and these two clothes overlap with each other, and are stitched with each other or adhered to each other along peripheral portions thereof for forming an air introducing space. A stitched or adhered portions (hereinafter, referred to as "stitched portion") is indicated by symbol 1*c*. Here, the stitched portion 1*c* includes not only a stitched portion formed along peripheries of the clothes but also stitched portions 1*d* at a plurality of portions of the second portion 12 which extend in the longitudinal direction toward the inside from a periphery of the second portion 12. These extended stitched portions 1*d* partition an air introduced space thus playing a role of averaging a thickness of the air bag jacket 1 when the air bag jacket 1 is inflated and maintaining a shape of the air bag jacket 1.

As shown in FIG. 2, a right periphery 14 of the belly portion 12*a* and a right periphery 15 of the waist portion 12*b* are stitched with each other or adhered to each other (the stitched portion being indicated by symbol 12*c*), and a left periphery 16 of the belly portion 12*a* and a left periphery 17 of the waist portion 12*b* are stitched with each other or adhered to each other (a stitched portion being indicated by symbol 12*d*). The first portion 11 having the annular portion includes a cutout portion 11*a* at a portion thereof. The air bag jacket shown in FIG. 2 is an inner jacket, and the rider wears the inner jacket with an outer jacket (not shown in the drawing) in a state that the inner jacket is accommodated inside the outer jacket.

Figure 4:
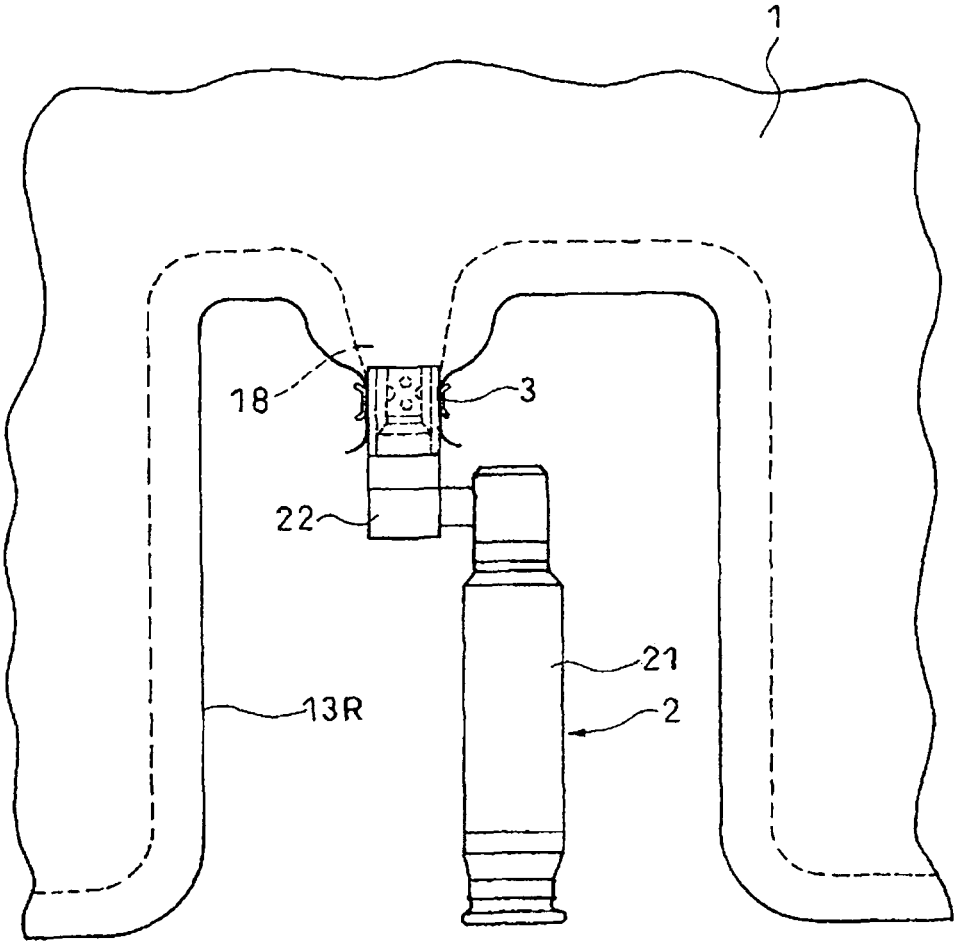
FIG. 4 is an enlarged view of an inflator mounted on the air bag jacket.

FIG. 4 is an enlarged view of the inflator 2 mounted on the air bag jacket 1. The inflator 2 may preferably be of a cylinder type which can generate a large quantity of gas even when the inflator 2 is of a small size in general from a view point that the inflator 2 is used in the air bag jacket 1 which the rider wears. The inflator 2 is constituted of a propellant accommodating casing 21 which accommodates a combustion chamber, an igniter, a propellant and the like and a diffuser casing 22 which houses a nozzle having a gas blow-off port. The inflator 2 shown in FIG. 4 is of a type in which a center line of the propellant accommodating casing 21 and a center line of the diffuser casing 22 are arranged offset from each other.

An inflator mounting port 18 is formed in the recessed portion 13R of the air bag jacket 1. The inflator mounting port 18 projects outwardly from a periphery of the recessed portion 13R. The diffuser casing 22 of the inflator 2 is inserted into the mounting port 18, and the diffuser casing 22 is firmly fastened to the mounting port 18 by a band (or a clamp) 3.

By mounting the inflator 2 in such a manner, the inflator 2 is stored in the inside of the recessed portion 13R of the air bag jacket 1 and hence, it is possible to prevent the inflator 2 from projecting toward the outside of the air bag jacket 1 (below the skirt of the air bag jacket 1). Here, the portion where the inflator 2 is stored is not limited to the recessed portion 13R, and the inflator 2 may be arranged in the recessed portion 13L, that is, a portion of the air bag jacket 1 corresponding to the left side of the air bag jacket 1.

Figure 5:
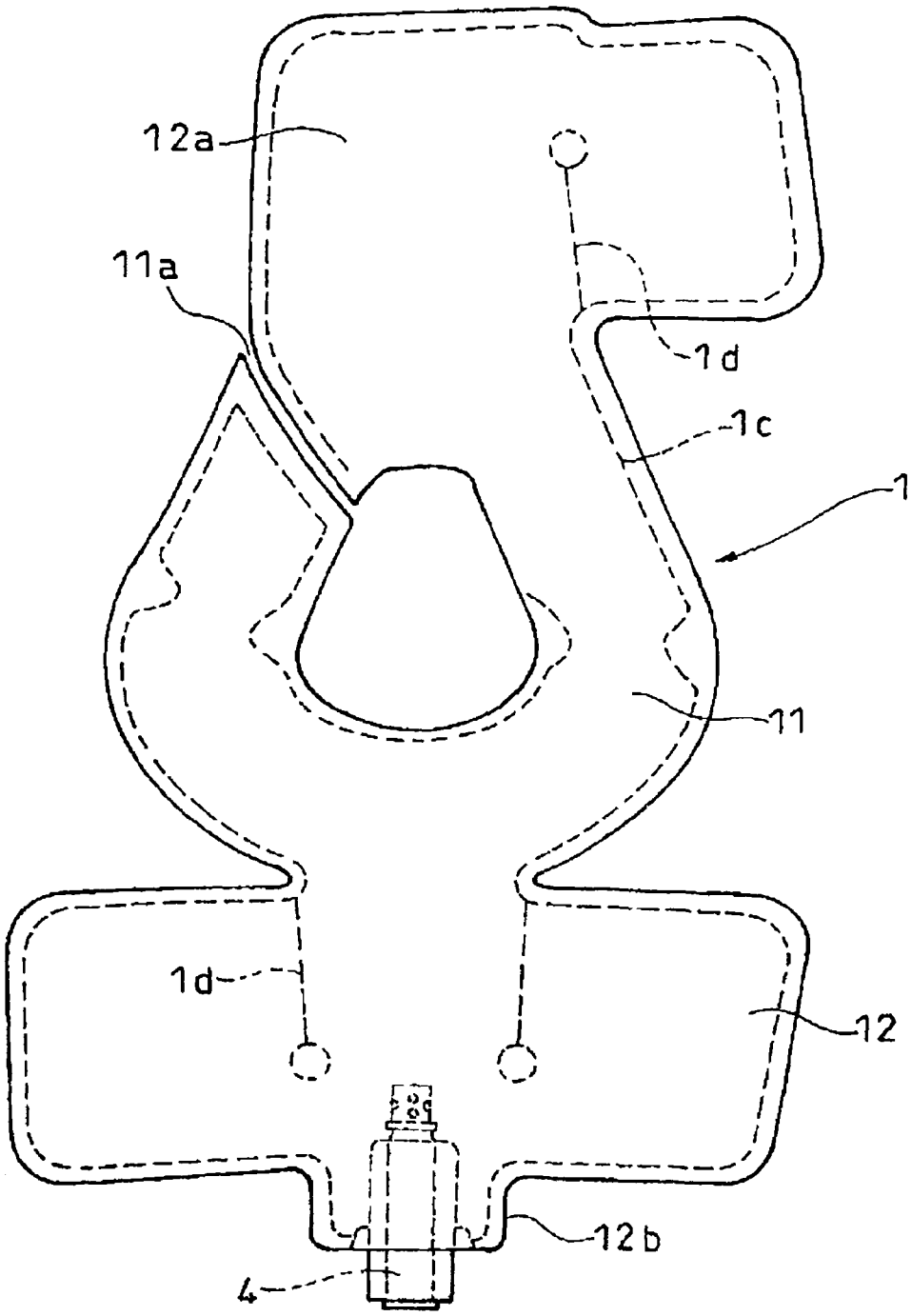
FIG. 5 is a developed view of an air bag jacket according to a second embodiment of the present invention.

Next, a second embodiment of the present invention is explained. FIG. 5 is a developed view of an air bag jacket 1 according to the second embodiment. Symbols which are equal to the symbols used in FIG. 1 indicate the same or similar parts. In this example, the air bag jacket 1 is not provided with the recessed portions 13L, 13R in the second portion 12. An inflator 4 is not arranged in a gulf-shaped cutout space such as the recessed portion 13L or 13R, but is arranged inside the air bag jacket 1 from a periphery of the air bag jacket 1 in an embedded manner. That is, the inflator 4 is inserted into the air bag jacket 1 upwardly from an end of a center skirt portion of a waist portion 12*b* of the air bag jacket 1 and is stored in the inside of the air bag jacket 1.

Figure 6:
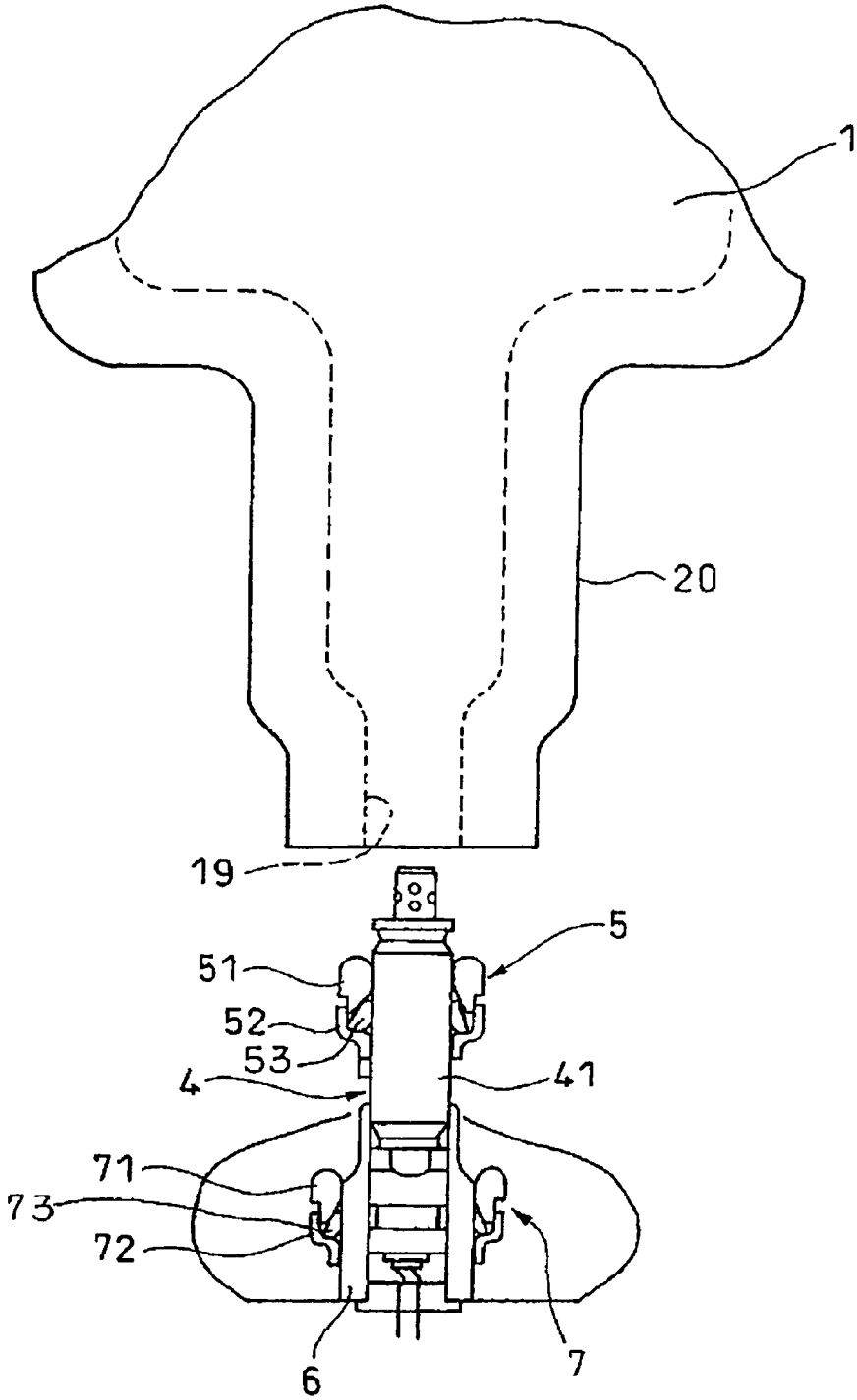
FIG. 6 is an enlarged view showing a first assembling stage of the air bag jacket according to the second embodiment of the present invention.
Figure 7:
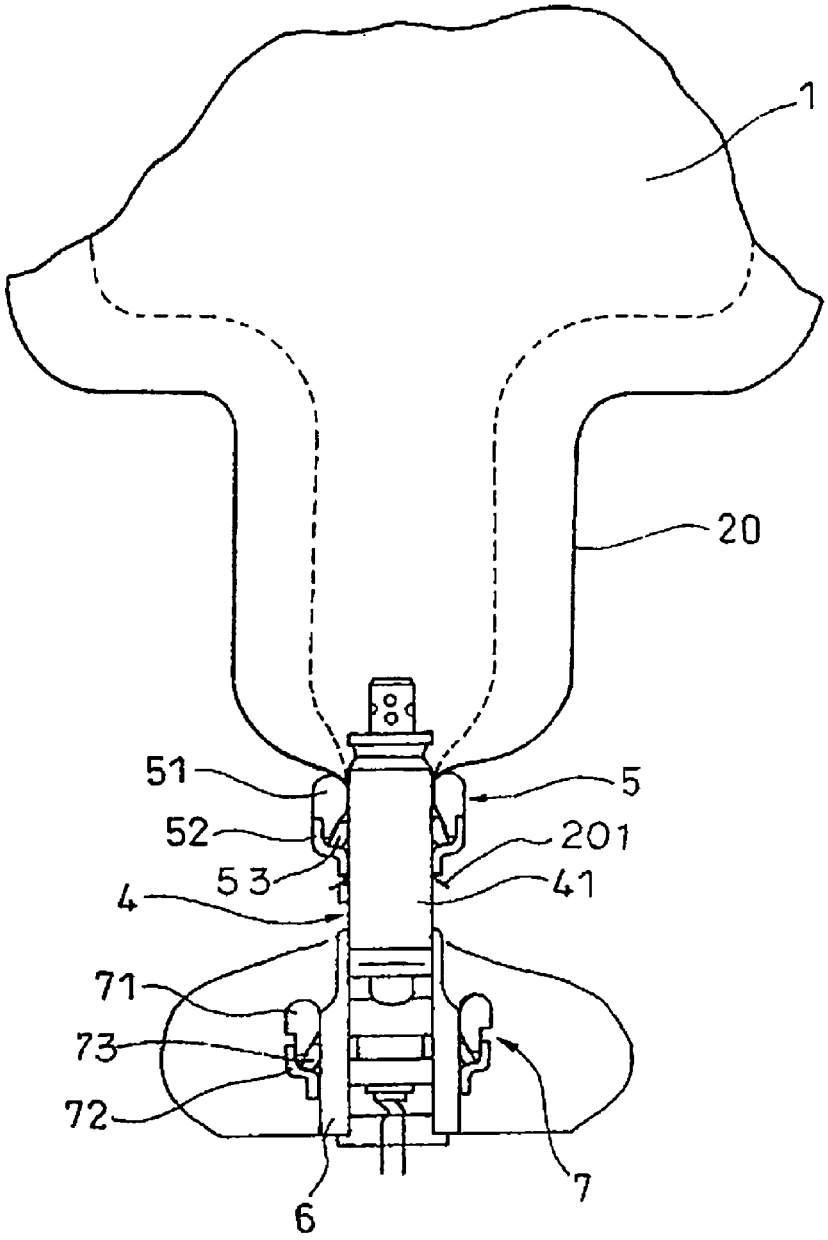
FIG. 7 is an enlarged view showing a second assembling stage of the air bag jacket according to the second embodiment of the present invention.
Figure 8:
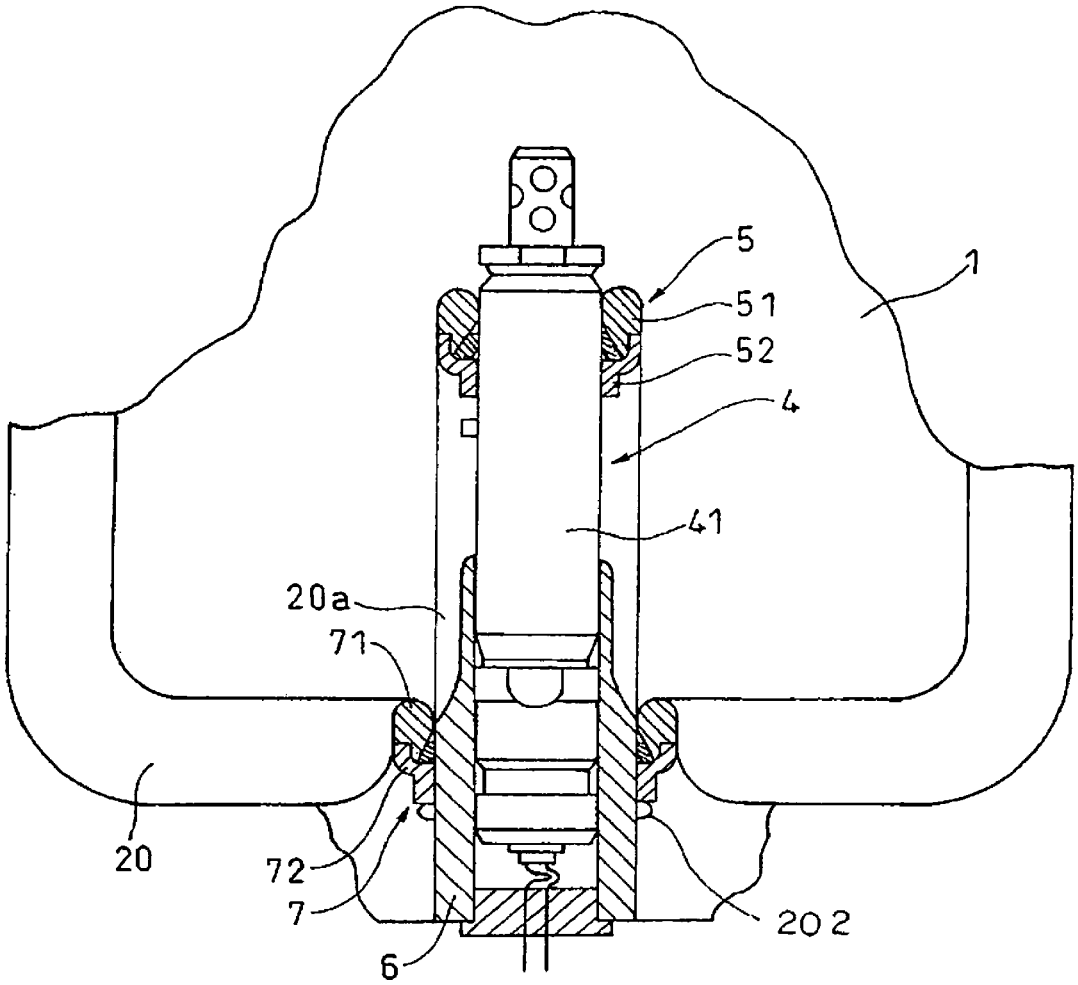
FIG. 8 is a view showing a final assembling stage of the air bag jacket according to the second embodiment of the present invention.

FIG. 6 to FIG. 8 are enlarged views showing steps for mounting the inflator 4 on the air bag jacket 1. First of all, in FIG. 6, the inflator 4 includes, different from the above-mentioned inflator 2, a cylinder 41 which is an integrally formed body of a propellant accommodating casing and a diffuser casing. A first clamp 5 is mounted on an upper portion (a portion close to a gas blow-off port) of the cylinder 41. A sleeve 6 is fitted on a lower portion of the cylinder 41, and a second clamp 7 of the same type as the first clamp 5 which is snugly fitted on an outer periphery of a sleeve having a diameter larger than the first clamp 5 (that is, sleeve 6) is mounted on an outer periphery of the sleeve 6. Here, the first clamp 5 includes a clamping portion 51 and a nut 52 threadedly engaged with threads formed on an outer periphery of a lower portion of the clamp portion 51. By fastening the nut 52 to the clamping portion 51, a seal ring 53 interposed between the clamp portion 51 and the nut 52 is deformed by compression and hence, the air bag jacket 1 sandwiched between the first clamp 5 and the cylinder 41 can be pushed from an outer periphery thereof. The second clamp 7 includes a clamping portion 71 and a nut 72 threadedly engaged with threads formed on an outer periphery of a lower portion of the clamp portion 71. By fastening the nut 72 to the clamping portion 71, a seal ring 73 interposed between the clamp portion 71 and the nut 72 is deformed by compression and hence, the air bag jacket 1 can be pushed from an outer periphery thereof between the second clamp 7 and the sleeve 6.

The inflator 4 having such a constitution is inserted into the inflator mounting port 19 which opens downwardly at a center skirt portion of the waist portion 12*b* of the air bag jacket 1. Here, as shown in FIG. 7, a tubular bulging portion 20 of the air bag jacket 1 in which the mounting port 19 is formed is squeezed to conform to an outer diameter of the cylinder 41, and is inserted between the clamp portion 51 of the first clamp 5 and the cylinder 41. In such a state, the nut 52 is fed by threading upwardly along the cylinder 41 so as to deform the seal ring 53 by pushing whereby the tubular bulging portion 20 is brought into close contact with an outer periphery of the cylinder 41. An end portion of the tubular bulging portion 20 extends below the nut 52 (symbol 201).

Subsequently, as shown in FIG. 8, the inflator 4 is further deeply inserted into the inside of the air bag jacket 1. That is, the inflator 4 is pushed upwardly in the drawing, and the tubular bulging portion 20 has an outer periphery thereof turned over to cover an outer periphery of the cylinder 41 and is pushed into the inside of the air bag jacket 1. When the inflator 4 is pushed to an extent that a turn-over portion 20*a* of the tubular bulging portion 20 reaches the clamp portion 71 of the second clamp 7, the tuned-back portion 20*a* of the tubular bulging portion 20 is sandwiched between the clamp portion 71 and the sleeve 6, the nut 72 is fed by threading to the clamp portion 71 along the sleeve 6 so as to deform the seal ring 73 by pushing whereby the turn-over portion 20*a* is brought into close contact with an outer periphery of the sleeve 6. In FIG. 8, symbol 202 indicates a folded-back portion of the tubular bulging portion 20.

Here, the first clamp 5 and the second clamp 7 are not limited to the above-mentioned constitution, and may be formed of a strip-shaped member or a string-shaped member which can bring an end portion of the tubular bulging portion 20 formed of a cylindrical cloth into close contact with the outer periphery of the cylinder 41 or can bring the turn-over portion 20*a* into close contact with the outer periphery of the sleeve 6. That is, the first clamp 5 and the second clamp 7 may be formed of a band or a wire.

By mounting the inflator 4 in such a manner, the inflator 4 is stored in the inside of the lower center skirt portion of the air bag jacket 1 and hence, it is possible to prevent the inflator 4 from projecting toward the outside of the air bag jacket 1 (downwardly from the air bag jacket 1).

Figure 9:
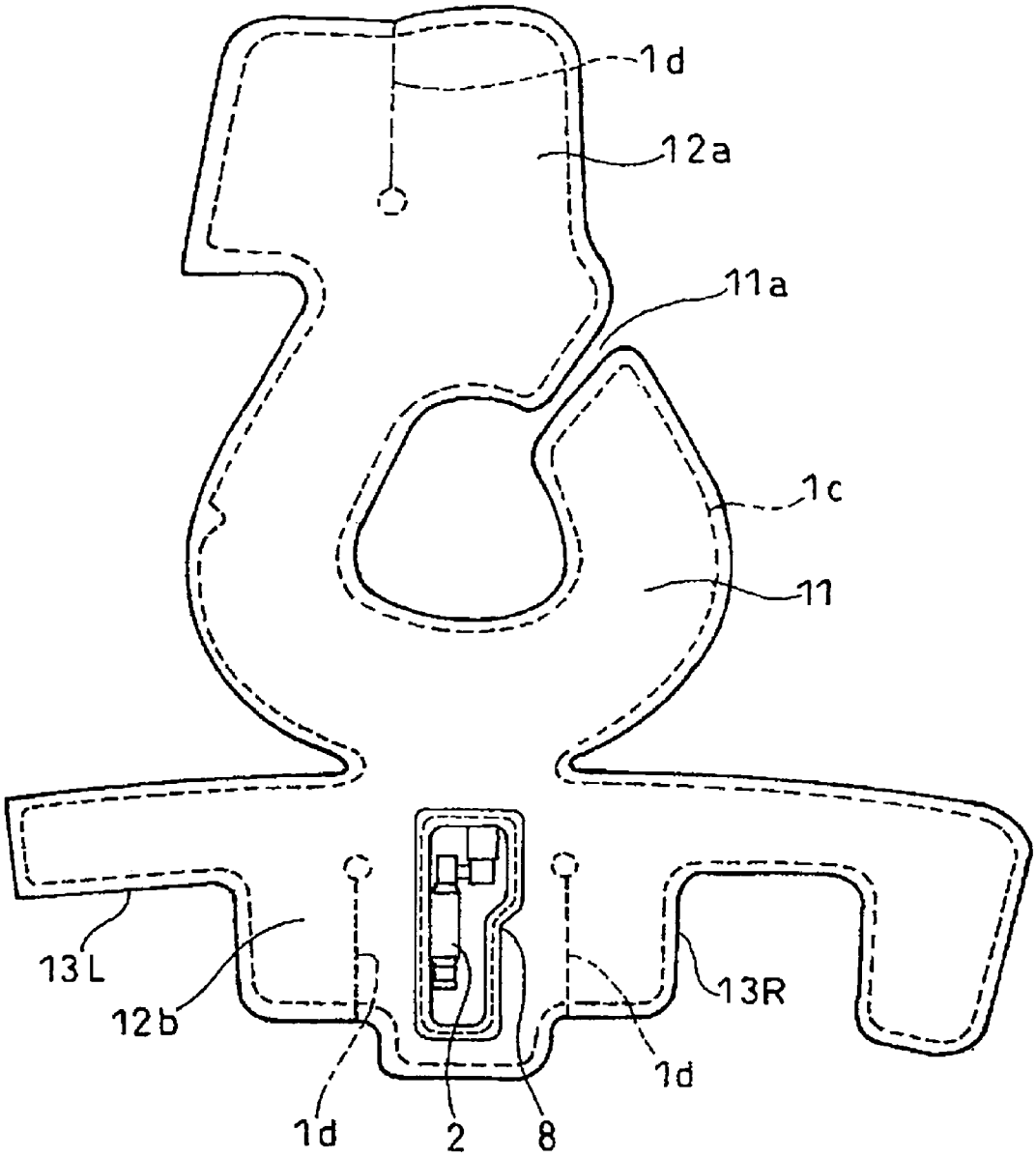
FIG. 9 is a developed view of an air bag jacket according to a third embodiment of the present invention.

Next, a third embodiment of the present invention is explained. FIG. 9 is a developed view of an air bag jacket 1 according to the third embodiment. Symbols which are equal to the symbols used in FIG. 1 indicate the same or similar parts. In FIG. 9, an inflator 2 is mounted on a center portion of a waist portion 12*b* of the air bag jacket 1. The inflator 2 is accommodated in the inside of a disc-shaped attachment 8 stitched or adhered to a cloth of the air bag jacket 1.

Figure 10:
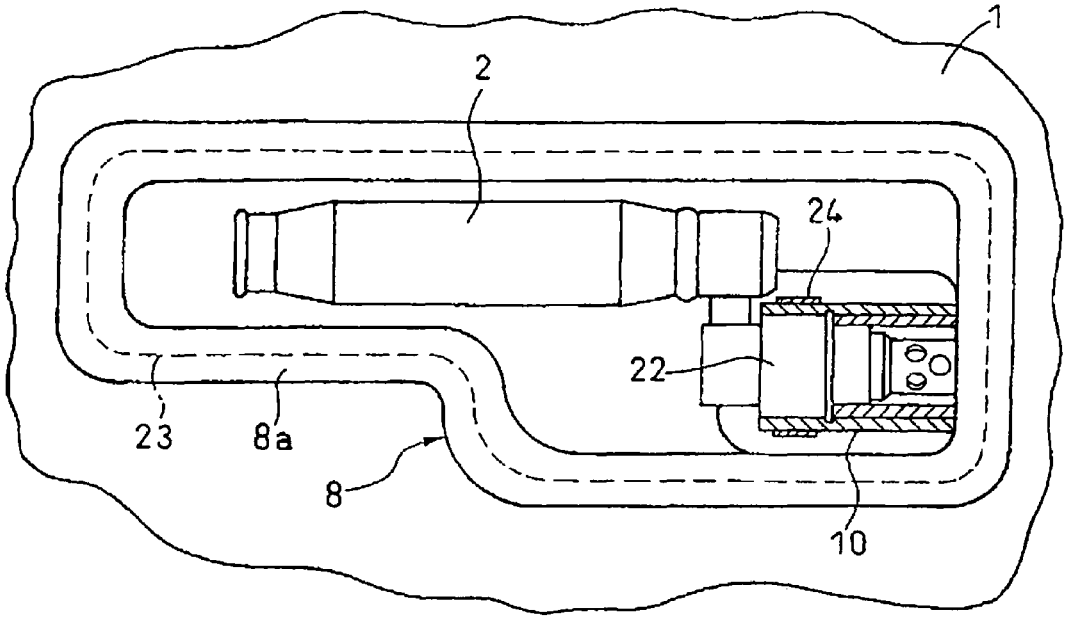
FIG. 10 is an enlarged front view of an essential part in FIG. 9.
Figure 11:
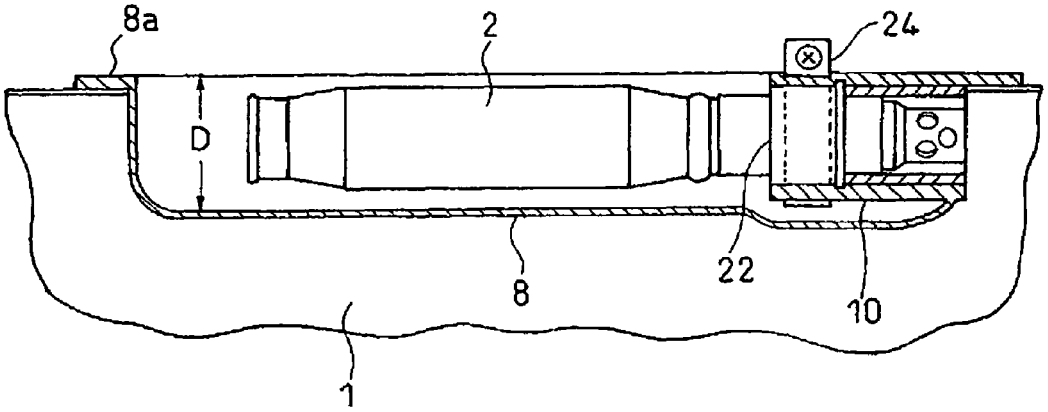
FIG. 11 a cross-sectional view of FIG. 10.

FIG. 10 is an enlarged view of an essential part in FIG. 9, and FIG. 11 is a cross-sectional view of FIG. 10. The attachment 8 is a disc-shaped member having a depth (D) of a degree which prevents the inflator 2 accommodated in the attachment 8 from projecting toward the outside from an outer surface of the air bag jacket 1. The attachment 8 has a flange portion 8*a* which is stitched or adhered to a cloth of the air bag jacket 1 and may be made of rubber, fabric or the like. In the air bag jacket 1, a cylindrical mounting port 10 into which a diffuser casing 22 of the inflator 2 can be inserted is formed. Symbol 23 indicates a stitched or adhered portion of the attachment 8. The diffuser casing 22 of the inflator 2 is inserted into the mounting port 10, and is fastened to the mounting port 10 by a fastening band 24 and hence, the inflator 2 is connected to the attachment 8.

The inflator mounted on the disc-shaped attachment 8 is not limited to an inflator having a shape shown in FIG. 9, and a propellant accommodating casing and a diffuser casing may be arranged coaxially. Further, a shape of the attachment 8 may be deformed in conformity with the shape of the inflator.

In this manner, according to the third embodiment, the inflator 2 is prevented from projecting toward the outside of the air bag jacket 1 and is accommodated in a recess formed in the inside of the attachment 8. Here, the disc-shaped attachment 8 may be provided with a sheet-shaped lid for covering the accommodated inflator 2.

Figure 12:
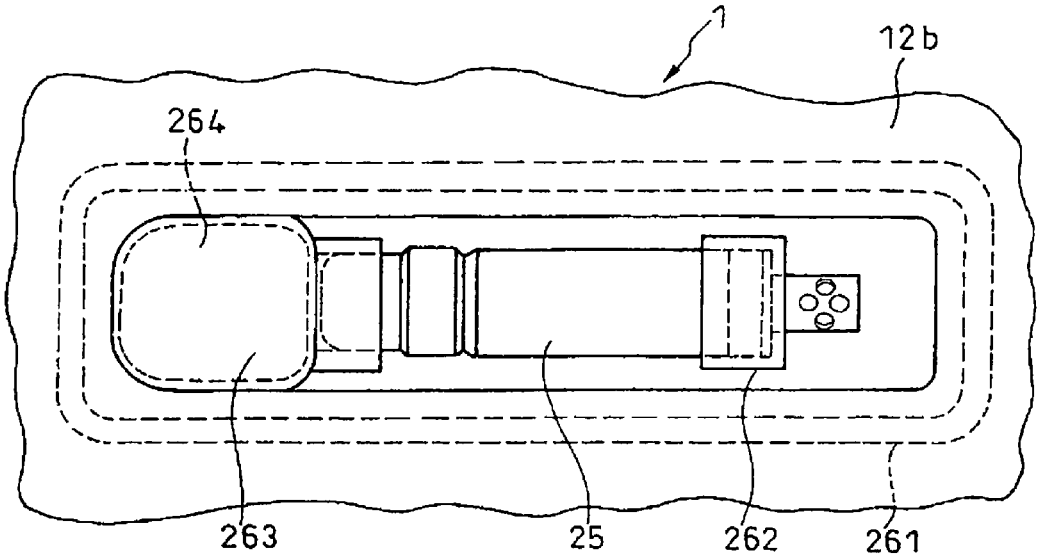
FIG. 12 is a front view of a part of an air bag jacket 1 according to a fourth embodiment of the present invention.
Figure 13:
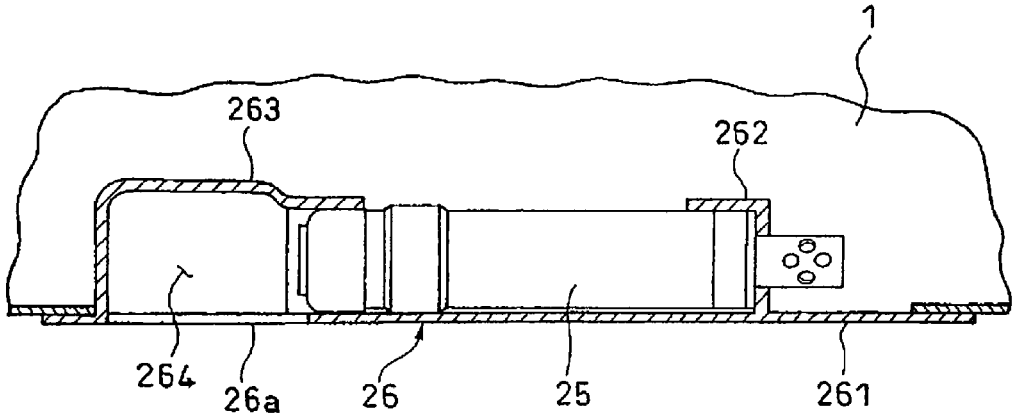
FIG. 13 a cross-sectional view of FIG. 12.

Next, a fourth embodiment of the present invention is explained. FIG. 12 is a front view of an essential part of the air bag jacket 1 according to the fourth embodiment (a view as viewed from an inner surface of the air bag jacket 1), and FIG. 13 is a cross-sectional view of the essential part. In this fourth embodiment, the inflator 25 is arranged inside a center portion of a waist portion 12*b* of the air bag jacket 1. The attachment 26 is made of a deformable material such as rubber or fabric. The attachment 26 includes a base portion 261 which has a periphery thereof stitched or adhered to a cloth of the air bag jacket 1, and a distal end support portion 262 and a rear end support portion 263 formed on the base portion 261 in a projecting manner toward the inside of the air bag jacket 1 for supporting the inflator 25. An operation space 264 for mounting the inflator 25 in these support portions 262, 263 is formed behind the rear end support portion 263. An opening 26*a* for assembling the inflator 25 in the inside of the air bag jacket 1 is formed in the operation space 264.

Figure 14:
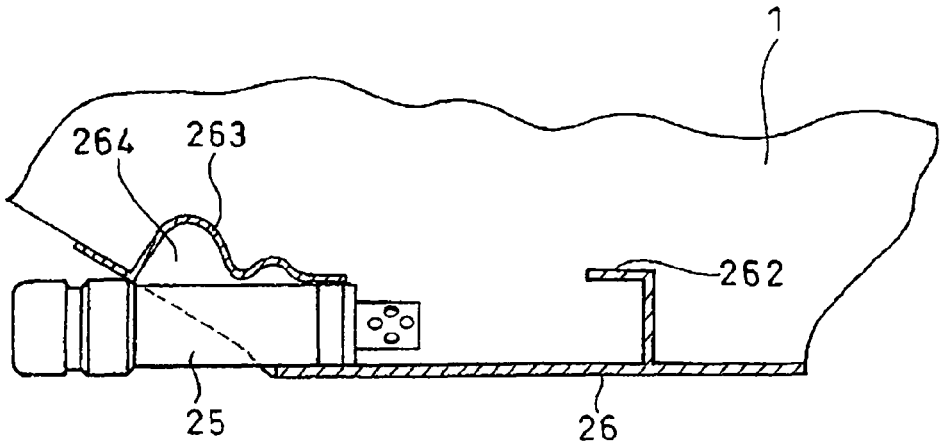
FIG. 14 is a cross-sectional view showing an inflator in an assembling stage to an attachment.

FIG. 14 is a cross-sectional view showing the inflator 25 in a stage that the inflator 25 is assembled to the attachment 26. As shown in the drawing, the operation space 264 of the air bag jacket 1 to which the attachment 26 is joined is deformed to expand the air bag jacket 1 by pushing so as to facilitate the insertion of the inflator 25 from the opening 26*a*. The inflator 25 is inserted into the inside of the air bag jacket 1 from the rear-end support-portion-263 side by way of the operation space 26 expanded by pushing in the above-mentioned manner. By inserting the inflator 25 into the inside of the air bag jacket 1 by pushing in the direction indicated by an arrow until a distal end portion of the inflator 25 is inserted into the distal end support portion 262, a rear end portion of the inflator 25 is brought into a state in which the rear end portion of the inflator 25 is surrounded by the rear end support portion 263, that is, is arranged at a position shown in FIG. 12 and FIG. 13. A gap defined between the rear end portion of the inflator 25 mounted on the attachment 26 and the rear end support portion 263 is sealed by filling an adhesive agent or the like in the gap.

In this manner, according to the fourth embodiment, the inflator 25 is accommodated in the inside of the air bag jacket 1 thus enabling the air bag jacket 1 to exhibit a planar appearance with no projecting portion to the outside thereof.

Figure 15:
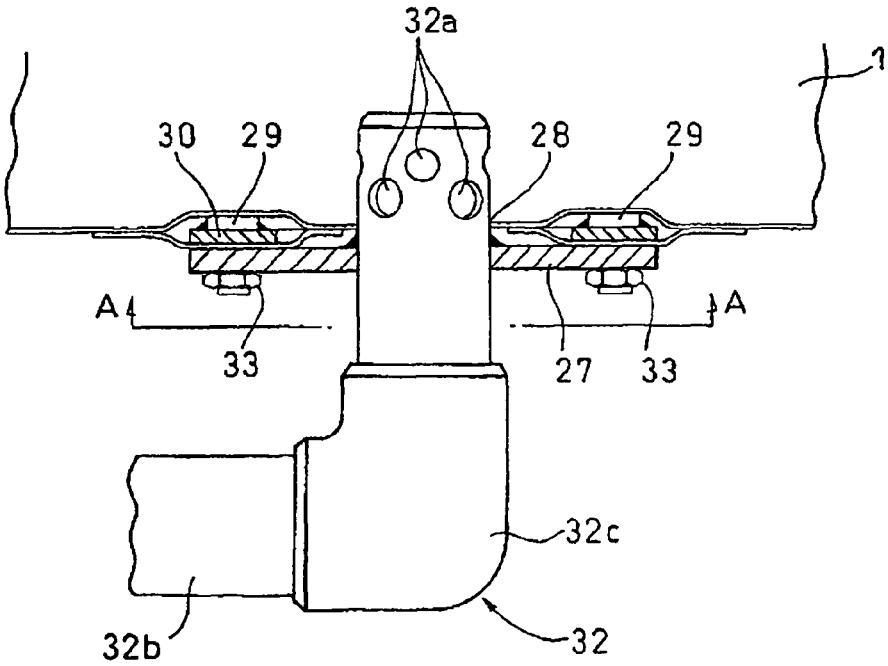
FIG. 15 is a cross-sectional view of a part of an air bag jacket according to a fifth embodiment of the present invention.
Figure 16:
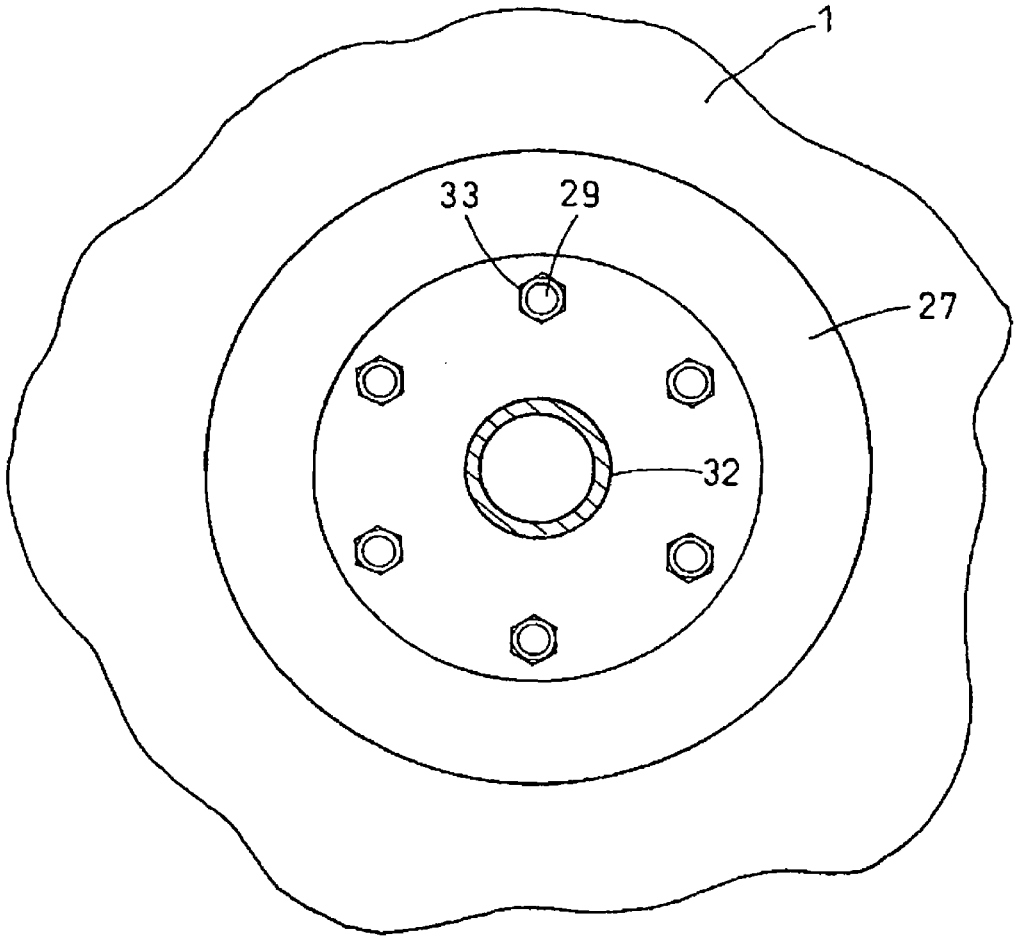
FIG. 16 is a cross-sectional view taken along a line A-A in FIG. 15.

Next, a fifth embodiment of the present invention is explained. FIG. 15 is a cross-sectional view of an essential part of the air bag jacket 1 according to the fifth embodiment, and FIG. 16 is a cross-sectional view taken along a line A-A in FIG. 15. In the fifth embodiment, the inflator 32 is mounted on an outer side of a center portion of a waist portion 12*b* of the air bag jacket 1. A hole is formed in a cloth of the air bag jacket 1, and an attachment 27 formed of a metal plate which conforms to the hole is fastened. To a periphery of the hole 28 formed in the air bag jacket 1, an annular bolt support plate 30 to which a plurality of bolts (6 bolts in this embodiment) 29 is held by welding is stitched along the hole 28. A distal end of the bolt 29 penetrates the air bag jacket 1 and projects to the outside of the air bag jacket 1.

A distal end of the inflator 32 is positioned such that blow-off ports 32*a* project to the inside of the air bag jacket 1, and is joined to the attachment 27 using a proper joining method such as a blazing. A through hole which conforms to the above-mentioned projecting bolt 29 is formed in the attachment 27, and in a state that the distal end of the inflator 32 with which the attachment 27 is integrally formed faces the hole 28 of the air bag jacket 1, the bolt 29 is allowed to penetrate the through hole of the attachment 27, and a nut 33 is threadedly engaged with the bolt 29.

In this mounting structure, the inflator 32 is configured such that a diffuser portion 32*c* is bent with respect to a propellant accommodating casing 32*b* arranged along a surface of the air bag jacket 1. Further, the attachment 27 and the inflator 32 are accommodated in the inside of a recess formed in the air bag jacket 1 in the same manner as the third embodiment.

In this manner, according to the fifth embodiment, by accommodating the inflator 32 in the recess formed in a surface of the air bag jacket 1, the inflator 32 can be mounted in a planar shape by eliminating a projecting portion which projects outwardly from the air bag jacket 1.

Figure 17:
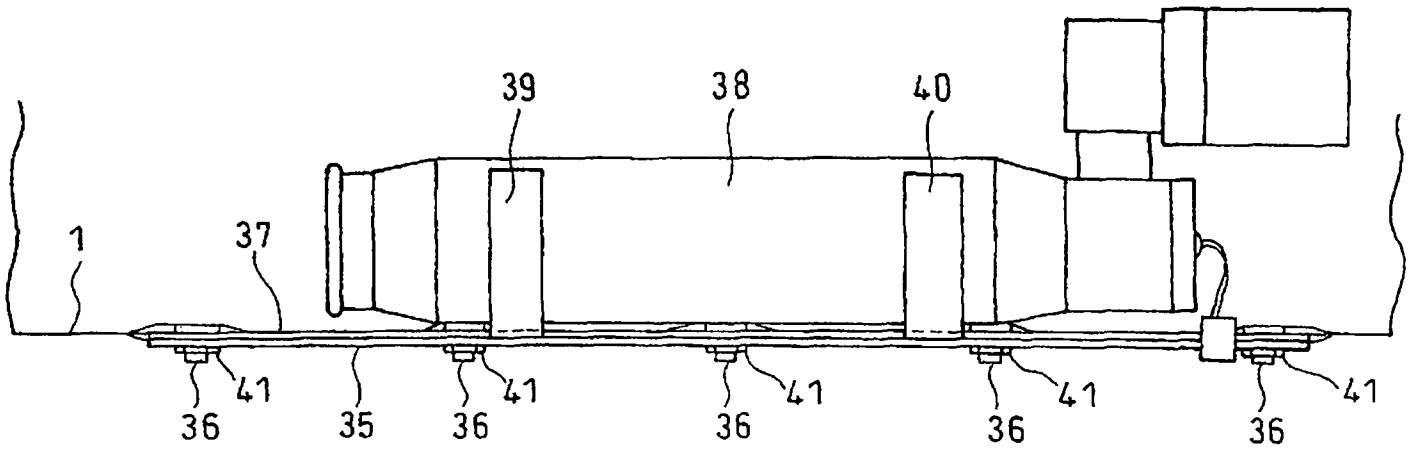
FIG. 17 is a cross-sectional view of a part of an air bag jacket according to a sixth embodiment of the present invention.
Figure 18:
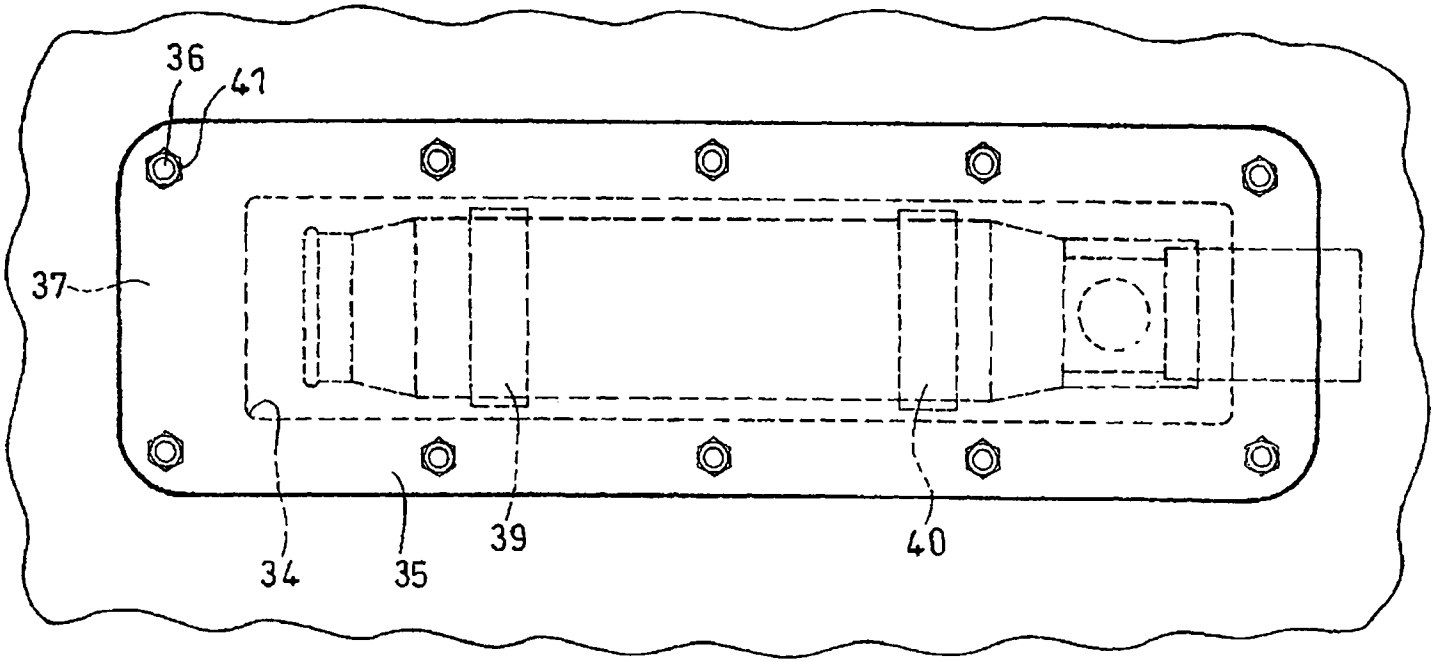
FIG. 18 is a front view of the part of the air bag jacket according to the sixth embodiment of the present invention.

Next, a sixth embodiment is explained. FIG. 17 is a cross-sectional view of an essential part of the air bag jacket 1 according to the sixth embodiment, and FIG. 18 is a front view of the essential part. In the sixth embodiment, an inflator 38 is mounted on an inner side of a center portion of a waist portion 12*b* of the air bag jacket 1. The inflator 38 is accommodated in the inside of the air bag jacket 1 using a metal attachment. An elongated hole 34 (see FIG. 18) is formed in a cloth of the air bag jacket 1, and an attachment 35 formed of a rectangular metal plate which conforms to the elongated hole 34 is fastened using bolts. To a periphery of the elongated hole 34 formed in the air bag jacket 1, a rectangular annular bolt support plate 37 to which a plurality of bolts (10 bolts in this embodiment) 36 is held by welding is stitched along the elongated hole 34. A distal end of the bolt 36 penetrates the air bag jacket 1 and projects to the outside of the air bag jacket 1.

The inflator 38 is held by clips (holding members) 39, 40 joined to an inner side of the attachment 35 (a surface which faces the inside of the air bag jacket), the attachment 35 is arranged to face the bolt support plate 37 in an opposed manner, and the bolts 36 are threadedly engaged with nuts 41 through the attachment 35. Due to such a constitution, the attachment 35 on which the inflator 38 is mounted is joined to the bolt support plate 37, and the inflator 38 is accommodated in the inside of the air bag jacket 1.

Figure 19:
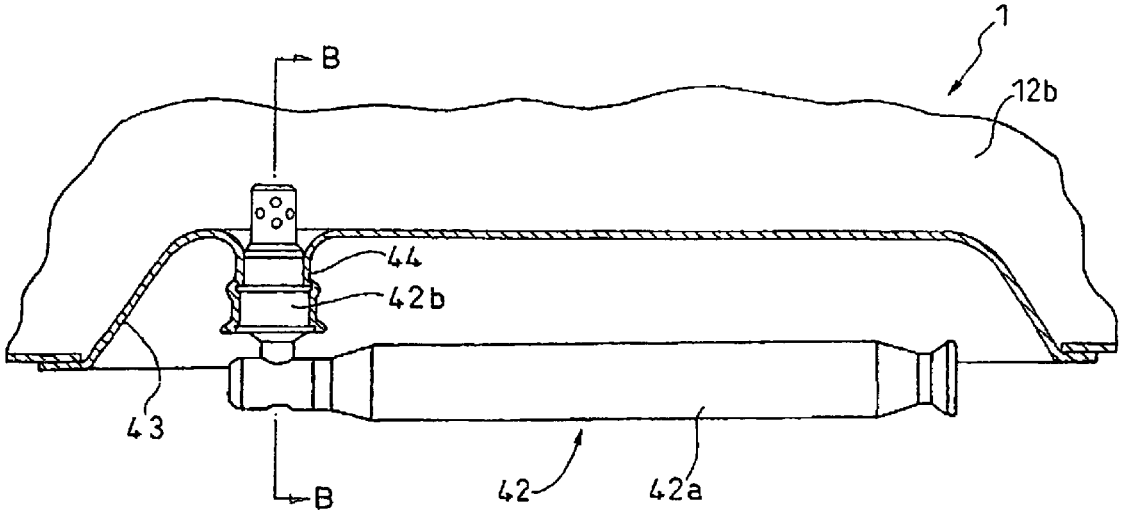
FIG. 19 is a vertical cross-sectional view of an air bag jacket according to a seventh embodiment of the present invention.
Figure 20:
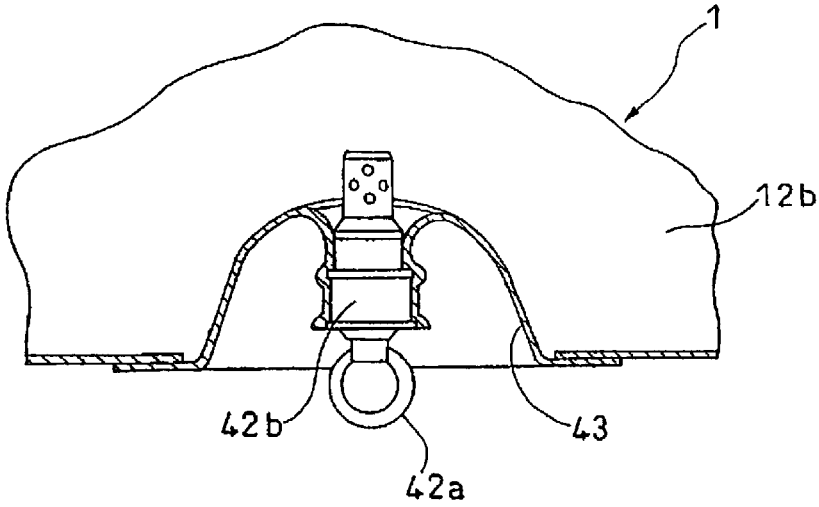
FIG. 20 is a cross-sectional view taken along a line B-B in FIG. 19.

Next, a seventh embodiment is explained. FIG. 19 is a longitudinal cross-sectional view of the air bag jacket 1 according to the seventh embodiment, and FIG. 20 is a cross-sectional view taken long a line B-B in FIG. 19. An inflator 42 is mounted in a state that a diffuser casing 42*b* is arranged orthogonal to a cylindrical propellant accommodating casing 42*a*. A rubber-made attachment 43 is stitched to a center portion of a waist portion 12*b* of the air bag jacket 1. The attachment 43 has a disc-shaped overall shape recessed toward the inside of the air bag jacket 1, and forms a cylindrical receiving portion 44 in which the diffuser casing 42*b* of the inflator 42 is fitted on a portion thereof. The inflator 42 is arranged such that the longitudinal direction of the propellant accommodating casing 42*a* is aligned with the longitudinal direction of the attachment 43, and the inflator 42 is fixed to the attachment 43 by allowing an outer periphery of the diffuser casing 42*b* to be fitted in an inner periphery of the receiving portion 44.

In the seventh embodiment, out of the inflator 42, the diffuser casing 42*b* is accommodated in the inside of a recess of the disc-shaped attachment 43 and is accommodated within a surface of the air bag jacket 1. However, the air bag jacket 1 may be configured such that the whole inflator 42 does not project from the surface of the air bag jacket 1 by deepening the recess of the disc-shaped attachment 43.

Next, an eighth embodiment and a ninth embodiment of the present invention are explained. In the eighth and ninth embodiments, an air bag jacket 1 is configured such that an inflator is connected to the air bag jacket 1 and, at the same time, the inflator is mounted on a pedestal to allow the fixing of the air bag jacket 1 to a body portion of a rider.

Figure 21:
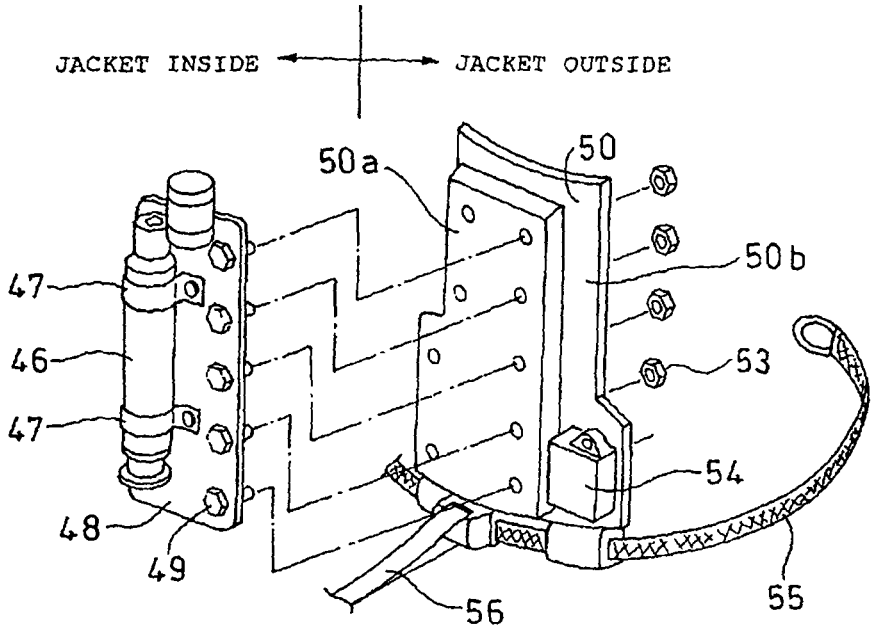
FIG. 21 is an exploded perspective view of an air bag jacket according to an eighth embodiment of the present invention.

FIG. 21 is an exploded perspective view of the air bag jacket 1 according to the eighth embodiment. The inflator 46 is mounted on an inner pedestal (attachment) 48 using clamps 47. Bolts 49 which are arranged to be directed such that distal ends thereof penetrate the air bag jacket 1 and project to the outside are welded to the inner pedestal 48. An outer pedestal 50 is mounted on an outer side of the air bag jacket 1, and the bolts 49 penetrate the outer pedestal 50 and are joined to nuts 53 on a back side of the outer pedestal 50. The outer pedestal 50 includes a surface 50*a* which faces the inner pedestal 48 by way of a cloth of the air bag jacket 1 and a base portion 50*b* formed in conformity with a shape of a back of a rider who wears the air bag jacket 1. An air-bag jacket-use ECU 54, a wearing belt 55 and an ELR belt 56 are mounted on the base portion 50*b*.

The wearing belt 55 is mounted around a body of the rider for surely mounting the air bag jacket 1 on the rider. The wearing belt 55 may be joined to the outer pedestal 50 or may be configured to pass through a sleeve 50*c* mounted on the outer pedestal 50. The ELR belt 56 has one end thereof mounted on the base portion 50*b* and the other end not shown in the drawing mounted on a frame of a motorcycle. Due to such a constitution, when a positional relationship of the rider with the motorcycle is displaced from a predetermined position when the rider escapes from the motorcycle or the like, a tension is applied to the ELR belt 56 so that information for operating the air bag jacket 1 is provided. When the ECU 54 detects the displacement of the rider from the predetermined position in response to the tension applied to the ELR belt 56, the ECU 54 outputs an ignition instruction to the inflator 46 to operate the air bag jacket 1.

Figure 22:
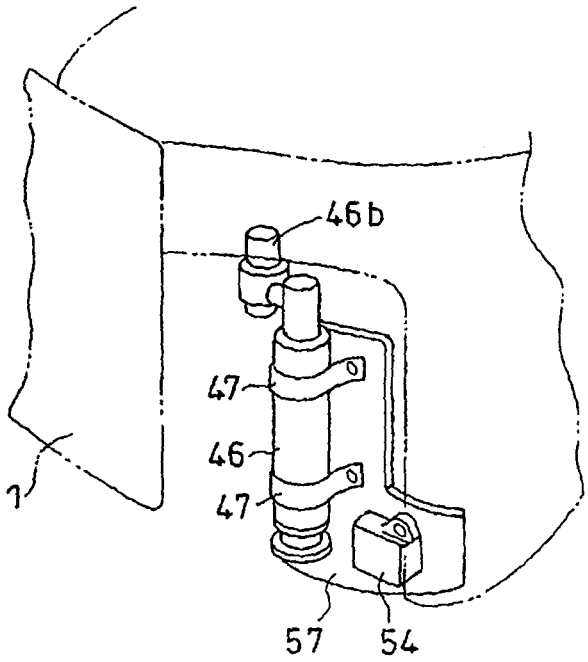
FIG. 22 is a perspective view of an air bag jacket according to a ninth embodiment of the present invention.

Next, the ninth embodiment of the present invention is explained. FIG. 22 is a perspective view of an air bag jacket 1 according to the ninth embodiment. An inflator 46 is mounted on a pedestal 57 by clamps 47. The pedestal 57 is constituted in the same manner as the corresponding pedestal shown in FIG. 21 with respect to a point that the pedestal 57 includes the ECU 54, a wearing belt and an ELR belt not shown in the drawing. However, in this ninth embodiment, the inflator 46 is arranged outside the air bag jacket 1, and an outer periphery of a diffuser casing 46*b* is connected to an inflator mounting port (similar to the mounting port indicated by symbol 18 in FIG. 4) of the air bag jacket 1. A connecting portion between the diffuser casing 46*b* and the air bag jacket 1 may be configured in the same manner as the connecting portions shown in FIG. 4, FIG. 19, FIG. 20 and the like. That is, a receiving portion similar to the receiving portion 45 or the mounting port 18 shown in FIG. 4 may be formed in a rubber-made attachment mounted on the air bag jacket 1, and the diffuser casing 46*b* is inserted into the receiving portion.

Further, this embodiment is not limited to the constitution which mounts the diffuser casing 46*b* on the air bag jacket 1. That is, in the structure pushing the whole inflator 4 into the air bag jacket 1 as has been explained in conjunction with FIG. 5 to FIG. 8, the base of the sleeve 6 mounted on the inflator 4 may be formed in the same manner as the pedestal 57, and the inflator 4 may be mounted on the rider by way of the sleeve 6 formed in this pedestal shape.

Figure 23:
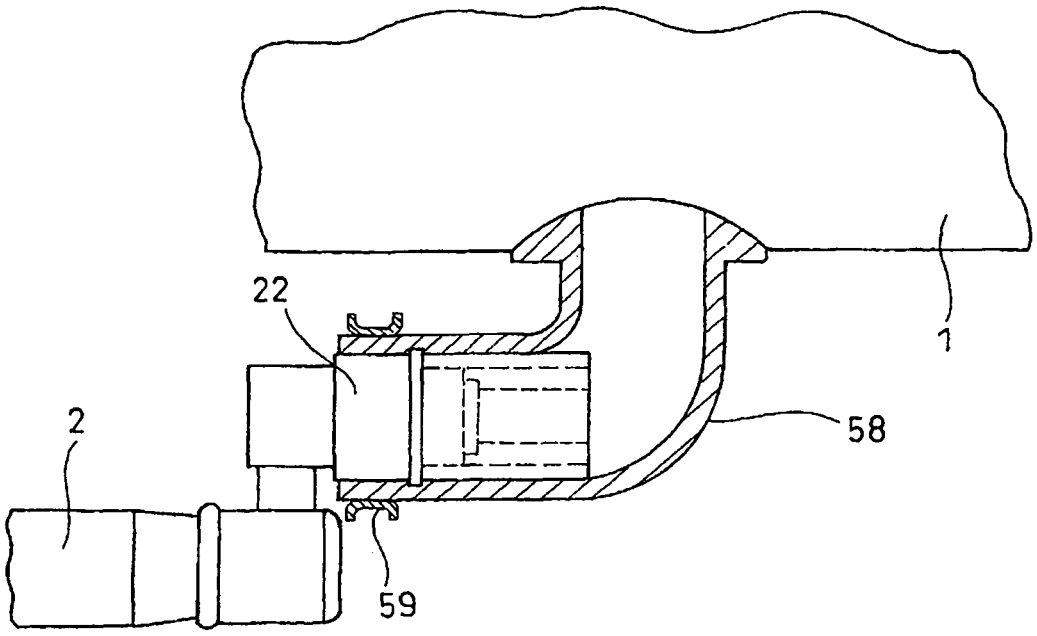
FIG. 23 is a cross-sectional view of a side surface of an attachment which is formed of a common cloth with the air bag jacket.

Here, for connecting the inflator to the air bag jacket 1, in place of the example which uses the attachment made of rubber or metal, the attachment may be formed of a cloth made of material equal to or substantially equal to a material for forming the air bag jacket 1 (common cloth). FIG. 23 is a view showing an example in which the attachment is formed of a cloth equal to or substantially equal to a cloth of the air bag jacket 1. In FIG. 23, the attachment 58 is made of the material equal to or substantially equal to the material of the air bag jacket 1 and forms an elbow tube. The attachment 58 is configured to abut a hole 59 formed in a second portion 12 of the air bag jacket 1 and mating portions of the attachment 58 and the hole 59 are stitched to each other, for example. An inflator 2 is configured such that an outer periphery of a diffuser casing 22 conforms to an inner periphery of the attachment 58 so that the diffuser casing 22 can be fitted in the attachment 58 and is fixed by a band 59. In this manner, by forming the attachment 58 using the common cloth with the air bag jacket 1, in a stitching step for manufacturing the air bag jacket 1, the attachment 58 can be stitched and hence, this embodiment is preferably used. Further, the attachment 58 is formed in an elbow shape and hence, the inflator 2 can be arranged along a surface of the air bag jacket 1. Further, the inflator can be easily mounted in a state that the air bag jacket is developed in plane.

As has been described heretofore, according to the embodiments of the present invention, it is possible to easily manufacture the air bag jacket with comfortable wearing feeling by preventing the inflator from projecting from the air bag jacket or by reducing a projection quantity of the inflator from the air bag jacket. Here, the above-mentioned embodiments merely show the most preferred embodiments of the present invention, and it is needless to say that the present invention is not limited to these embodiments, and the present invention is applicable by properly modifying shapes, sizes and materials of the inflator, the attachment and the pedestal without departing from the gist of the present invention.

We claim:

1. A motorcycle air bag jacket comprising:

a first portion corresponding to a first portion adapted to correspond to a breast and an upper back portion of a user in a wearing state; and the first portion includes an annular portion which surrounds a neck portion of the user;

the first portion having the annular portion includes a cutout portion at a portion thereof;

the cutout portion is in the breast portion of the user in a wearing state, and is provided at a location biased from the center in a width direction of the airbag jacket;

a second portion corresponding to a belly and a waist of the user in a wearing state;

a rectangular-shaped recessed cutout portion formed in the bottom end of the second portion of the air bag jacket, said rectangular-shaped recessed cutout portion located at either a right or left side of the user in the wearing state, said rectangular-shaped recessed cutout portion is not formed behind an exterior surface of the second portion of the air bag jacket;

an inflator;

an inflator mounting port formed in a horizontal surface of the recessed cutout portion and projecting downward and away from the annular portion of the motorcycle airbag jacket; and a diffuser casing, accommodating a gas blow-off port of the inflator therein, inserted into the inflator mounting port, wherein the diffuser casing is fastened to the inflator mounting port by a clamp, the inflator is entirely arranged within a space defined by rectangular-shaped recessed cutout portion such that when the airbag jacket is in the wearing state the entire inflator is completely visible from the outside view, and the motorcycle airbag jacket is configured to inflate upon the user being displaced from a predetermined position on the motorcycle, in order to mitigate an impact on the user of the motorcycle.

2. The air bag jacket according to claim 1, wherein the diffuser casing is clamped to the downwardly projecting portion formed in the periphery of the rectangular-shaped recessed cutout portion.

3. The airbag jacket according to claim 1, wherein said rectangular-shaped recessed cutout portion includes an open end positioned on the bottom end of the second portion of the air bag jacket.

* * * * *